US007325966B2

(12) United States Patent
Gassenschmidt

(10) Patent No.: US 7,325,966 B2
(45) Date of Patent: Feb. 5, 2008

(54) DEVICE FOR DISPERSION AND/OR HOMOGENIZATION

(75) Inventor: Jörg Gassenschmidt, Bad Krozingen (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 149 days.

(21) Appl. No.: 10/837,987

(22) Filed: May 3, 2004

(65) Prior Publication Data

US 2004/0223407 A1 Nov. 11, 2004

(30) Foreign Application Priority Data

May 9, 2003 (DE) ..... 103 20 739

(51) Int. Cl.
*B01F 5/10* (2006.01)

(52) U.S. Cl. ..... 366/136; 366/178.3; 366/304

(58) Field of Classification Search ..... 366/136, 366/137, 155.1, 178.1, 178.3, 181.1, 181.3, 366/304

See application file for complete search history.

(56) References Cited

U.S. PATENT DOCUMENTS

| | | | | |
|---|---|---|---|---|
| 3,940,115 | A | 2/1976 | Zipperer et al. | |
| 4,239,396 | A * | 12/1980 | Arribau et al. | 366/2 |
| 4,610,548 | A | 9/1986 | Hallet et al. | |
| 4,834,547 | A | 5/1989 | Niskanen | |
| 5,931,579 | A * | 8/1999 | Gallus et al. | 366/163.2 |
| 6,854,878 | B2 * | 2/2005 | Jacob | 366/304 |
| 2001/0036125 | A1 | 11/2001 | Bachelier et al. | |
| 2004/0213080 | A1 * | 10/2004 | Schertenleib | 366/171.1 |

FOREIGN PATENT DOCUMENTS

| | | | |
|---|---|---|---|
| DE | 11 40 440 | 11/1962 | |
| DE | 3417242 | 11/1985 | |
| DE | 19608222 | 7/1996 | |
| DE | 19629945 | 1/1998 | |
| DE | 19916053 | 10/2000 | |
| EP | 0036067 | 9/1981 | |
| EP | 0204294 | 12/1986 | |
| EP | 0290033 | 11/1988 | |
| EP | 0988887 | 3/2000 | |
| EP | 1155733 | 11/2001 | |
| EP | 1197260 | 4/2002 | |
| WO | WO 93/10665 | 6/1993 | |
| WO | 03002241 | 1/2003 | |
| WO | WO 03/022416 | * 3/2003 | |

* cited by examiner

*Primary Examiner*—David Sorkin
(74) *Attorney, Agent, or Firm*—Volpe and Koenig, P.C.

(57) ABSTRACT

A device (1) which includes a dispersing and/or homogenizing tool (2) and a pump (7) located on the same shaft (10), wherein a pumpable material can be fed from a receptacle, especially a container (3) or a pipe, to the dispersing and/or homogenizing tool (2). This material can be mixed in the dispersing and homogenizing tool (2) with an additive, which is led through a feeding line (5) and a region (5*a*) arranged concentric to the supply line (4) to an opening (6) before the dispersing and homogenizing tool (2). The pump (7) arranged at a distance before the opening (6) and before the dispersing and homogenizing tool (2), and has a pumping pressure in the flow direction, which, in the region of this opening (6), is less than the suctioning pressure of the tool (2). For influencing the pressure in the supply line (4), a device for changing or reducing the size of the cross section of the supply line (4) can be provided, which is preferably formed as a blocking device (8) in order to be able to also completely close the supply line (4).

13 Claims, 2 Drawing Sheets

DEVICE FOR DISPERSION AND/OR HOMOGENIZATION

BACKGROUND

The invention relates to a device for dispersion and/or homogenization with a dispersing and/or homogenizing tool, in which a pumpable material or a pumpable mixture is mixed with at least one additive. The pumpable material or the like can be fed from a receptacle, especially from a container or from a pipe, to the dispersing and/or homogenizing tool. In addition, for the additive or additives there is a feeding line, which opens into the supply line of the pumpable material in front of the tool. The feeding line and the supply line are concentric to each other at least in the area of the opening.

A structurally comparable device is known from DE 196 29 945 A1 and has been proven effective. However, here a dry material or pourable solids are fed at the center and fluid is fed from the side concentrically. At first, with the help of mixing tools a pumpable mixture is formed from these components, and then this mixture is fed in this form to the dispersing and/or homogenizing tool.

In contrast, if an additive is fed to and mixed with a pumpable material, especially of a high viscosity, there is the risk that the suctioning effect of the dispersing and/or homogenizing tool will not be sufficient even with optional pump blades in order to suction the pumpable material and simultaneously to generate a sufficiently high suctioning force to also suction the additive or additives accordingly in order to be able to convey both materials together through the dispersing and/or homogenizing tool.

SUMMARY

Therefore, the objective is to create a device of the type mentioned in the introduction, with which materials of high viscosity can also be processed with sufficient flowability and can be mixed with additives through homogenization and/or dispersion.

Here, the term material of high viscosity with sufficient flowability is understood to refer to, e.g., a cream, a toothpaste, or a material with somewhat honey-like consistency.

To solve the previously mentioned problem, the device defined in the introduction is further characterized in that at least one pump is arranged at a distance in front of the dispersing and/or homogenizing tool and in front of the opening of the feeding line in the feeding direction of the material, and the pumping pressure of the pump in the flow direction in the region of the feeding line opening is less than the suction pressure of the dispersing and/or homogenizing tool.

In this way, the pumpable or flowable material is exposed to a conveying effect before the inlet of the additive or additives, so that despite its relatively high viscosity this material is fed to the dispersing or homogenizing tool, which is also called "homogenizer" for short in the following, without breaking down its flow. Consequently, an appropriate additive can be suctioned and entrained from the feeding line or lines and thus led into the homogenizer. Therefore, at the required position, the suctioning of the homogenizer can be effective without having to completely suction the pumpable material. The pump guarantees that, despite its high viscosity, this pumpable material is led into the region of the suction effect by the homogenizer or the pump which supports this suctioning effect, so that the additive or additives are also entrained in order to for subsequent dispersion and/or homogenization.

One configuration of the invention of great significance, which is considered worthy of its own protective rights, includes arranging a device for changing or reducing the size of the cross section of the supply line for the pumpable material from the pump to the opening of the supply line. Thus, the device can be adapted to pumpable materials of different viscosities or materials, whose viscosity changes during the processing, if, e.g., a portion of the pumpable material separates and returns into the container and is then transported again through the pump and the supply line. Furthermore, the viscosity can change when the device is started and thus during a corresponding process, e.g., when certain thickening or thinning agents are gradually added to the pumpable and flowable material, e.g., before entry into the pump, i.e., the device for changing or reducing the size of the cross section of the supply line can also be helpful primarily in a startup phase of the device or in the process performed by this device.

Furthermore, through additives, the result behind the homogenizer can vary in its viscosity, so that throttling or an enlargement of the cross section of the supply line and thus the amount of pumpable material can also be necessary to be able to set a desired end result.

Finally, this possibility of changing or reducing the size of the cross section of the supply line is advantageous, because the device for original materials of different viscosities can be used and various materials can be matched optimally to these different viscosities.

Another configuration of the invention can include building the device for changing the cross section of the supply line as a blocking device and branching, in particular, a return line into the container between the pump and the device for changing the cross section of the supply line.

Thus, the supply line can change not only in its cross section, but it can also be completely closed. This is necessary primarily when the pumpable and flowable material from the container is to be pumped back into the container in order to initially better pre-mix this material, which can contain several components, before it is supplied to the homogenizer and united with one or more additives before entry into the homogenizer. In addition, this arrangement with one blocking device and at least one return line has the advantage that the device can be thoroughly cleaned by circulating a corresponding cleaning fluid with the help of the pump and by introducing spray nozzles as high as possible in the container or even above the container.

For a favorable structural solution, it is especially advantageous if the pump or the pump impeller is arranged on the same shaft as the dispersing and/or homogenizing tool and if between the pressurized pump chamber and the shaft as well as the feeding line for the additive, which is arranged concentrically, particularly within the supply line, there is a seal, which is pressed against this shaft and which separates the pressurized part of the pump from the suction region of the additive in the feeding line. In this way, only a single drive motor is needed for the pump and the homogenizer. Simultaneously, this configuration guarantees that the entry of the additive into the pumpable material is performed as uniformly as possible.

Here, it is advantageous if the supply line and feeding line, which are arranged concentric to each other, are also concentric to the sealed shaft crossing these lines for the pump and the dispersing and/or homogenizing tool. Thus, channels with annular cross sections for the pumpable material and the additive or additives are produced in the area of the concentric profile of the feeding line and supply line, wherein through the innermost ring, the correspondingly sealed and shielded shaft runs from the homogenizer to the pump. This also leads to a compact, space-saving arrangement.

Behind the dispersing and/or homogenizing tool in the feeding direction, an outlet line can be provided, which can lead, in particular, back into the container before the pump. Therefore, it is possible to gradually mix the original material from the container more and more with one or more additives and then to feed the material back to the container until a desired total mixture, which also exhibits a corresponding degree of homogeneity, is produced.

In addition to the outlet line or preferably on the outlet line leading back into the container, an emptying line or emptying valve can be provided, which can be connected over a valve, e.g., a three-path cock, to the outlet line and return line.

To be able to discharge the resultant material coming from the homogenizer, a separate emptying line or emptying valve or preferably a branch provided on the already mentioned outlet line leading back into the container can be provided as an emptying line or emptying valve, which can then be opened or blocked selectively in the last case, e.g., over a two-path cock, if return of the mixture into the container is desired.

The outlet line can open into the return line leading away directly behind the pump and a blocking valve can be arranged, especially in the form of a three-path cock, on the opening. Thus, a portion of the return line can be used for returning both the pumpable material before its entry into the homogenizer and also the material that has already been mixed with an additive and homogenized.

The suctioning effect of the dispersing and/or homogenizing tool can be amplified by at least one pump impeller, which is arranged behind this tool in the feeding direction and/or at the input into this tool and which is especially connected to the tool. This is especially advantageous if the pumpable material and/or the additives have a high viscosity.

In front of the pump in the feeding direction, at least one stirring tool can be arranged in the container. This can improve the pre-mixing of the pumpable and flowable material, which itself is often already a mixture of several components, before entry into the pump.

For a good transporting effect of the material or materials of high viscosity, it is advantageous if the container is arranged vertically above the pump and the pump is arranged vertically above the dispersing and/or homogenizing tool and if the supply line and the feeding line are directed downstream in the region before the dispersing and/or homogenizing tool, thus especially in the region of its concentric arrangement. Thus, the feeding of the often highly viscous material is supported by gravity.

The feeding line for the additive can be built projecting to the side in this region before its area arranged concentric to the supply line. Thus, this feeding line can run as close as possible to the container, and for a vertical arrangement it can run underneath the container as tight as possible to its concentric region.

The opening of the feeding line into the supply line can be provided at the entry into the dispersing and/or homogenizing tool. The closer the opening is arranged to the homogenizer, the more effective is its suctioning effect.

The dispersing and/or homogenizing tool can be a rotor-stator device especially with several rotor crown teeth and/or stator crown teeth in a concentric arrangement to each other. A correspondingly intensive homogenizing effect is thus possible.

The combination of one or more of the previously described features and means primarily produces a device, which can be used separately or also installed in pipe lines. It can be used advantageously in mixing and emulsifying systems and preferably has a mixing container with a central base outflow, which leads to the pump. Here, an external circulating line, which leads out from the container at the base outflow and which returns to the top part of the container in a rising line, can amplify the mixing effect and be used for good cleaning. The arrangement of the homogenizing and/or dispersing tool in a circulating line, which leads back into the container, enables a more effective and more intensive dispersing or homogenizing of the mixing material and enables additional functions, such as pumping out and primarily circulation of the mixing material and later a cleaning medium.

BRIEF DESCRIPTION OF THE DRAWINGS

In the following, an exemplary embodiment of the invention is described in more detail with reference to the drawing. In the drawings, shown in partially schematic representation.

DETAILED DESCRIPTION OF THE PREFERRED EMBODIMENTS

A device designated overall with 1 is used for dispersing and/or homogenizing and for this purpose has a dispersing and/or homogenizing tool 2 that can be seen primarily in FIG. 2 and that is also called "homogenizer" 2 or optionally "tool" 2 in the following. This homogenizer 2 allows a pumpable and flowable material or a corresponding pumpable material mixture to be mixed with at least one additive.

Figure 1:
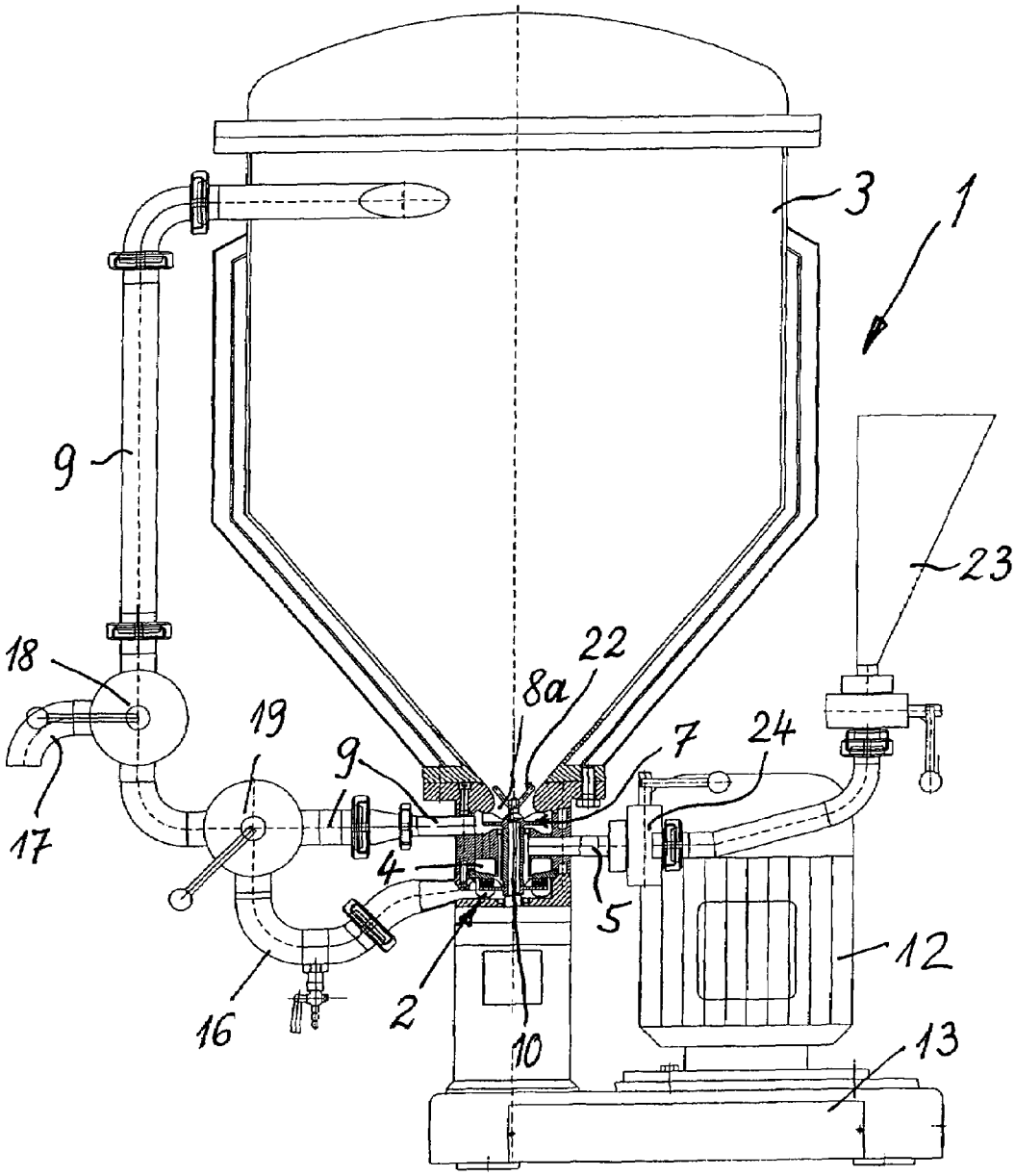
FIG. 1 is a side view taken partially in the longitudinal section of a device according to the invention for dispersing and/or homogenizing with a receptacle formed as a container with base outflow and under which a pump is arranged on the same shaft as a dispersing and/or homogenizing tool lying below this pump, wherein between the pump impeller and the dispersing and/or homogenizing tool a feeding line for additives runs concentric to the supply line from the pump to the tool.
Figure 2:
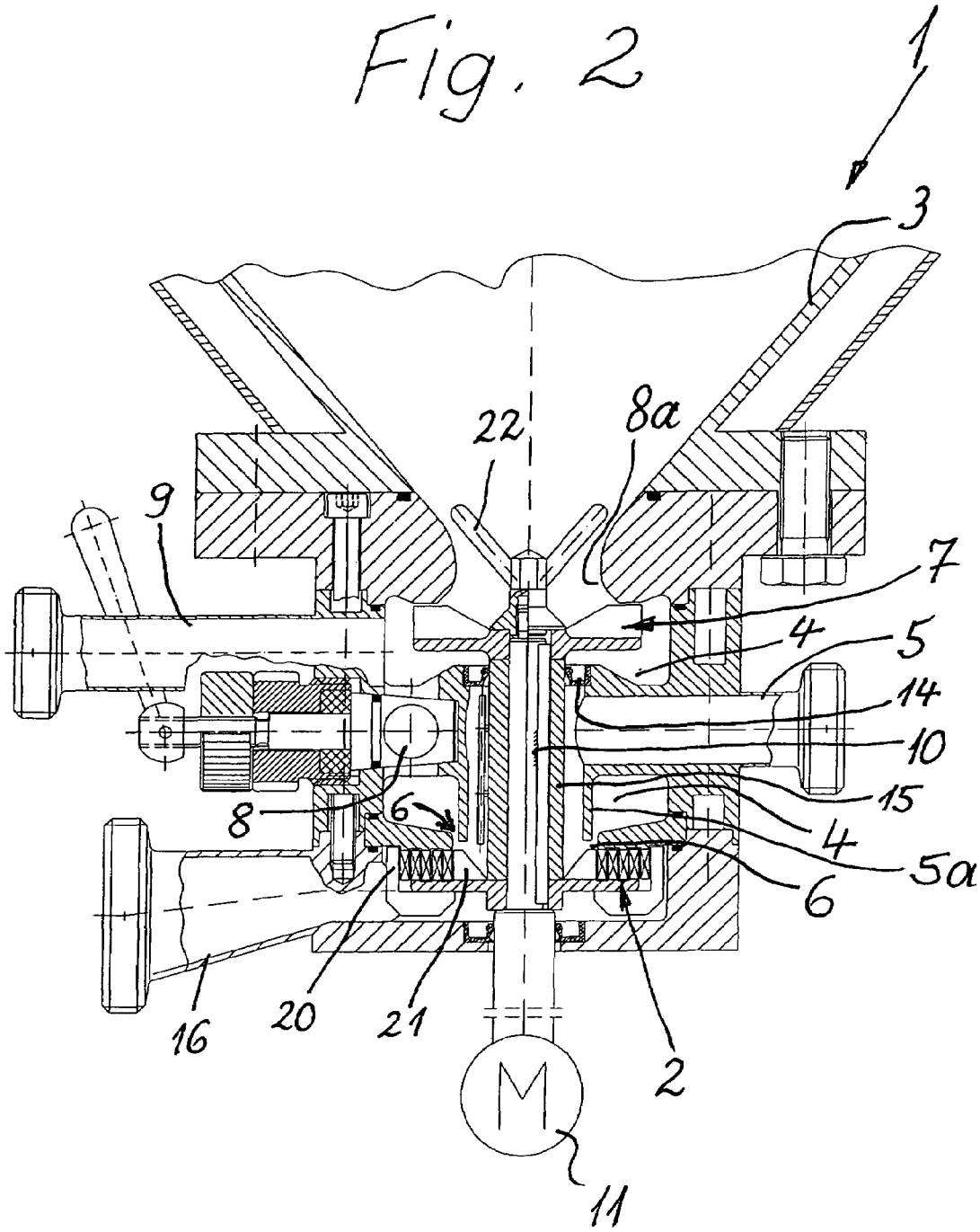
FIG. 2 is a larger scale longitudinal section view through the base region of the container, the pump located below the container, the supply line from the pump to the dispersing and/or homogenizing tool with the feeding line for an additive arranged concentrically in this region, wherein the drive shown more clearly in FIG. 1 and includes a motor and gearing of the common shaft for the dispersing and homogenizing tool and pump shown schematically.

For this purpose, the pumpable material can be fed from a receptacle, in the embodiment shown from a container 3, which can also be double walled according to FIGS. 1 and 2 at least in sections, to the homogenizer 2 through a supply line 4, which is a pump chamber in the exemplary embodiment at least in sections. For the additive or additives, a feeding line 5 is provided, which opens into the supply line 4 before the tool 2, wherein the feeding line 5 and the supply line 4 extend concentric to each other at least in the region of the opening 6 as well as before the opening. This arrangement can be seen especially clearly in FIG. 2.

In the feeding direction of the material at a distance in front of the dispersing and/or homogenizing tool 2 and in front of the opening 6 of the concentric region 5*a* of the feeding line 5 there is a pump 7, whose impeller can be seen clearly primarily in FIG. 2 underneath a base outflow 8*a* of the container 3. The pumping pressure pointed downstream in the direction of flow in the embodiment is here less in the region of the opening 6 of the feeding line 5 than the suctioning pressure of the dispersing and/or homogenizing tool 2, so that even for high viscosity the flow of material cannot be separated in front of this opening 6, i.e., these means guarantee a desired flow of material even of high viscosity at the opening 6 of the material coming from the container 3 in order to be able to then flow together with a corresponding amount of additive and then to be mixed and/or homogenized.

In the supply line 4 of the pumpable material, one can see between the pump 7 and the opening 6 a device for changing or reducing the size of the cross section of this supply line 4, which is here formed as a blocking device 8 in the embodiment, so that either the amount of pumpable material can be throttled through partial activation of the blocking device or else the throughput can be completely blocked by this blocking device 8.

Furthermore, between the pump 7 and this device for changing the cross section or blocking device 8, there is a return line 9, which returns according to FIG. 1 into the receptacle or container 3 and permits circulation of its contents or cleaning fluid. Circulation can be necessary primarily if additives are to be added to this flowable material before or within the container 3, before it is mixed with the additive and homogenized.

This blocking device 8 further allows adaptation to different viscosities of material, which can either occur during the process itself or else must be taken into account when different materials are to be treated with the device 1 one after the other.

One can see primarily in FIG. 2 that the pump 7 or its pump impeller is arranged on the same shaft 10 as the dispersing and/or homogenizing tool 2, so that only a single drive 11, e.g., the motor 12 with belt drive 13 shown in FIG. 1 is required. Between the pressurized pump chamber, the part of the supply line 4 located directly in the region of the pump 7, and the shaft 10, as well as the feeding line 5 arranged within the supply line 4 and its region 5*a* arranged concentric to the supply line 4 there is a seal 14, which presses against the shaft 10 and which separates the pressurized part of the pump 7 from the suction region in the feeding line 5 and the opening 6. Thus, the compact construction shown in the drawing is possible.

The supply line 4 and feeding line 5 with its region 5*a* arranged concentric to each other are also arranged concentric to the sealed shaft 10 crossing the lines and separated from the shaft by a shaft sleeve 15 surrounding the shaft.

After the homogenizer 2 in the feeding direction there is an outlet line 16, whose profile is shown primarily in FIG. 1. In this embodiment, the outlet line 16 is fed back into the container 3 before the pump 7 in an as yet to be described manner. Here, on the outlet line 16 leading back into the container 3 there is an emptying line 17 with emptying valve 18, so that over this valve 18, e.g., a three-path cock, the emptying line 17 is connected to the outlet or return line 9, which is connected to the outlet line 16 or forms a part of this line in a way still to be described.

One can see, namely in FIG. 1, that the outlet line 16 opens into the return line 9 leading away directly behind the pump 7 and a blocking valve 19 is arranged at the opening in the form of a three-path cock, so that after this blocking valve 19, the return line 9 and the outlet line 16 are a common line, which leads on one hand to the emptying line 17 and on the other hand into the container 3.

Thus, not only the material from the container 3 can be circulated over the line 9, but also the mixture formed in the homogenizer 2 can be either emptied or similarly circulated once or several times in order to increase the concentration of the fed material in the end product.

The suctioning effect of the dispersing and/or homogenizing tool 2 which is important for the uniform supply of material and the additive is amplified in the embodiment by a pump impeller 20 and 21 arranged behind this tool 2 in the feeding direction and at the input into this tool 2.

One can further recognize a stirring tool 22 in the feeding direction before the pump 7 and its impeller in the container in the region of its base outflow 8*a*, whereby the material can be pre-mixed before entry into the pump 7, if it consists on its side of several components.

The receptacle or the container 3 is located vertically above the pump 7 and the pump 7 is located on its side vertically above the homogenizer 2, so that the supply line 4 and the concentric region 5*a* of the feeding line 5 are directed downstream in the region before the homogenizer 2, so that the feeding of the material to the homogenizer 2 is supported by gravity, which is primarily advantageous for materials of high viscosity.

Here, the feeding line 5 is formed to project before its region 5*a* arranged concentric to the supply line 4 at the side of this region 5*a*, so that it can run underneath the container 3 in a space-saving way. In FIG. 1, one can see a filling or dosing funnel 23, through which an additive can be introduced into the feeding line 5.

The opening 6 of the feeding line 5 or its concentric region 5*a* into the supply line 4 is provided directly at the entry into the dispersing and/or homogenizing tool 2 in order to make the best possible use of its suctioning effect. Here, this dispersing and/or homogenizing tool 2 is a rotor-stator device with several rotor crown gears and stator crown gears in a concentric arrangement in order to be able to work effectively accordingly.

The stirring tool 22 can generate areas of turbulence in the lower region of the mixing container 3, so that sedimentation of mixed material is prevented. This simultaneously also makes possible the processing of small amounts of materials. Such processing of small amounts is especially advantageous in connection with a conical container and circulation lines, which can feed the mixed material also deeper than shown in FIG. 1 back to the mixture container. With the help of the line 9, the mixed material can be circulated without shearing, thus without use of the homogenizer 2 but also with shearing, thus after passage through the homogenizer 2. Here, other effects can be achieved through optional changes in rpm. A cleaning fluid can be further circulated in order to be able to clean the individual components of the device 1.

For circulation without use of the homogenizer, the blocking device 8 is closed.

If this blocking device 8 is only partially closed and used as a throttle, the feeding stream coming from the pump 7 is throttled. Here, the throttling can be selected so that the pumping effect or the suctioning effect of the subsequent homogenizer is greater than that of the pump 7. Therefore, a low pressure is created between the homogenizer 2 and pump 7, which is then applied to the inlet for the additive. By opening a valve 24 provided there, the additive can be suctioned from the feeding funnel 23, wherein the additive can be fluid or also powdery materials. Applying a vacuum or low pressure to the mixture container 3 is not required, but can further improve the suctioning power.

The device 1 features a dispersing and/or homogenizing tool 2 and a pump 7 on the same shaft 10, with which a pumpable material can be fed from a receptacle, especially a container 3 or a pipe, to the dispersing and/or homogenizing tool 2. This material can be mixed in the dispersing and/or homogenizing tool 2 with an additive, which is led through a feeding line 5 and region 5*a* arranged concentric to the supply line 4 to an opening 6 before the dispersing and homogenizing tool 2. The pump 7 arranged at a distance before the opening 6 and before the dispersing and homogenizing tool 2 here in the flow direction has a pumping pressure, which in the region of this opening 6 is less than the suctioning pressure of the tool 2. Here, for influencing this pressure in the supply line 4 there is a device for changing or reducing the size of the cross section of the supply line 4, thus a throttle, which is preferably formed as a blocking device 8 in order to be able to also completely close the supply line 4.

The invention claimed is:

1. A device (1) for dispersion and/or homogenization comprising a dispersing and/or homogenizing tool (2), in which a pumpable material or a pumpable mixture is mixed with at least one additive, wherein the pumpable material is adapted to be fed from a container to the dispersing and/or homogenizing tool (2) and a feeding line (5) is provided for the at least one additive, which opens into a supply line (4) for the pumpable material at a location before the tool (2), the feeding line (5) and the supply line (4) are arranged concentric to each other at least in a region of an opening (6) to the tool (2), at least one impeller pump (7) located at a distance before the dispersing and/or homogenizing tool (2) and before the opening (6) of the feeding line (5) in a feed direction of the material, whose pumping pressure in a flow direction in the region of the opening (6) of the feeding line (5) is less than a suctioning pressure of the dispersing and/or homogenizing tool (2), and an arrangement for varying a size of a cross section of the supply line (4) between a fully closed and a fully open position is located in the supply line of the pumpable material from the impeller pump (7) to the opening (6) of the supply line.

2. The device according to claim 1, wherein at least one of the impeller pump (7) and a pump impeller of the pump is arranged on a common shaft (10) with the dispersing and/or homogenizing tool (2), and a seal (14) is located between a pressurized chamber of the pump and the shaft as well as the feeding line (5) for the additive that is arranged concentrically within the supply line (4), the seal presses against the shaft (10) and separates the pressurized chamber of the pump (7) from a suctioning area of the additive in the feeding line (5).

3. The device according to claim 2, wherein the supply line (4) and the feeding line (5) which are arranged concentric to each other are also arranged concentric to the sealed shaft (10) for the pump and the dispersing and/or homogenizing tool.

4. The device according to claim 1, wherein in the feed direction behind the dispersing and/or homogenizing tool there is an outlet line (16), which is fed back into the container located before the pump (7).

5. The device according to claim 4, wherein there is an emptying line (17) or emptying valve (18) in or on the outlet line (16) leading back into the container, which is connected by a valve to the outlet line and return line.

6. The device according to claim 5, wherein the outlet line (16) opens into the return line (9) leading away directly behind the pump (7) and a blocking valve (19) is arranged at an opening thereof.

7. The device according to claim 1, wherein the suctioning effect of the dispersing and/or homogenizing tool (2) is amplified by at least one pump impeller (20, 27) arranged in the feed direction behind the tool (2) and/or at an input to the tool (2).

8. The device according to claim 1, further comprising at least one stirring tool (22) arranged in the container (3) located before the pump (7) in the feed direction.

9. The device according to claim 1, wherein the container (3) is arranged vertically above the pump (7), the pump (7) is arranged vertically above the dispersing and/or homogenizing tool (2), and the supply line (4) and the feeding line (5) are directed downstream in a region before the dispersing and homogenizing tool (2).

10. The device according to claim 1, wherein the feeding line (5) for the additive is arranged to project sideways before a region (5*a*) in which the feeding line (5) is arranged concentric to the supply line (4).

11. The device according to claim 10, wherein the opening (6) of the feeding line (5, 5*a*) is provided in the supply line (4) at an entry into the dispersing and/or homogenizing tool (2).

12. The device according to claim 1, wherein the dispersing and/or homogenizing tool (2) is a rotor-stator device having a plurality of rotor crown teeth and/or stator crown teeth in a concentric arrangement to each other.

13. A device (1) for dispersion and/or homogenization comprising a dispersing and/or homogenizing tool (2), in which a pumpable material or a pumpable mixture is mixed with at least one additive, wherein the pumpable material is adapted to be fed from a container to the dispersing and/or homogenizing tool (2) and a feeding line (5) is provided for the at least one additive, which opens into a supply line (4) for the pumpable material at a location before the tool (2), the feeding line (5) and the supply line (4) are arranged concentric to each other at least in a region of an opening (6) to the tool (2), at least one pump (7) located at a distance before the dispersing and/or homogenizing tool (2) and before the opening (6) of the feeding line (5) in a feed direction of the material, whose pumping pressure in a flow direction in the region of the opening (6) of the feeding line (5) is less than a suctioning pressure of the dispersing and/or homogenizing tool (2), and an arrangement for changing or reducing a size of a cross section of the supply line (4) is located in the supply line of the pumpable material from the pump (7) to the opening (6) of the supply line, and the device for changing the cross section of the supply line comprises a blocking device (8) and a return line (9) that branches from the container (3) is located between the pump and the device for changing the cross section of the supply line.

* * * * *